US006811729B2

(12) United States Patent
Attar

(10) Patent No.: US 6,811,729 B2
(45) Date of Patent: Nov. 2, 2004

(54) ONE PIECE REFLECTIVE PAVEMENT MARKER AND METHOD OF MAKING

(76) Inventor: Adil Attar, P.O. Box 3883, Ontario, CA (US) 91761

( * ) Notice: Subject to any disclaimer, the term of this patent is extended or adjusted under 35 U.S.C. 154(b) by 0 days.

(21) Appl. No.: 09/982,044

(22) Filed: Oct. 19, 2001

(65) Prior Publication Data

US 2002/0025222 A1 Feb. 28, 2002

Related U.S. Application Data

(63) Continuation-in-part of application No. PCT/US00/22449, filed on Aug. 15, 2000, and a continuation-in-part of application No. 09/880,780, filed on Jun. 13, 2001, and a continuation-in-part of application No. 09/634,430, filed on Aug. 8, 2000, now Pat. No. 6,698,972, and a continuation-in-part of application No. 09/385,091, filed on Aug. 30, 1999, now Pat. No. 6,334,734.

(51) Int. Cl.[7] ..... B29D 11/00; E01F 9/06

(52) U.S. Cl. ..... 264/1.9; 264/81; 404/14; 404/16

(58) Field of Search ..... 264/1.1, 1.7, 1.9, 264/81; 427/163.1; 404/12, 14, 16

(56) References Cited

U.S. PATENT DOCUMENTS 4,726,706 A * 2/1988 Attar ..... 404/14
6,264,860 B1 * 7/2001 Attar ..... 264/1.9
6,334,734 B1 * 1/2002 Attar ..... 404/16
6,505,994 B1 * 1/2003 Attar ..... 404/16

* cited by examiner

*Primary Examiner*—Mathieu D. Vargot

(57) ABSTRACT

A process of monolithically forming one-piece reflective pavement marker or delineator, including at least one retro reflective face. The process is based on molding the pavement marker or delineator with means to integrally form cube-corner reflective elements and internal hollow cavity air gaps simultaneously. The pavement marker also provides means to enhance agglutination to the roadway. The open ends of hollow cavities at the marker base can be sealed, thereby maximizing the base area for adhesive wetting parameter.

The monolithically formed reflective marker can be made, either from one type of plastic, or from two polymers with varied specifications, said polymer is to be from high impact and abrasion resistance thermoplastics. The integrally formed reflective face provided with means to form cube-corner reflective elements on designated cell like areas within the inside surface of said reflective face. The reflective pavement marker further provided with means to enhance abrasion resistant surface.

1 Claim, 11 Drawing Sheets

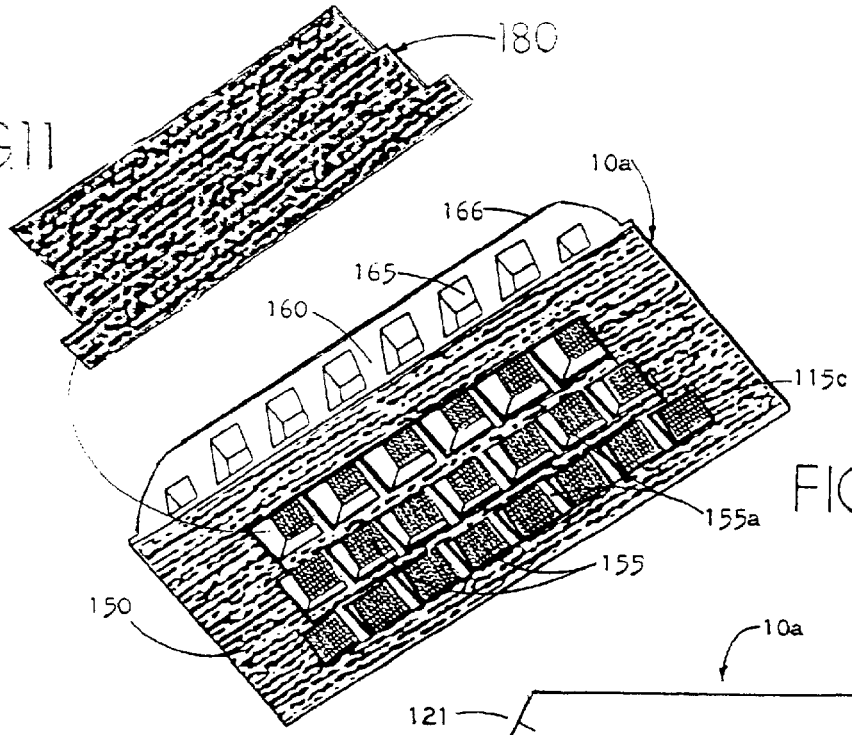
FIG.11
FIG.10
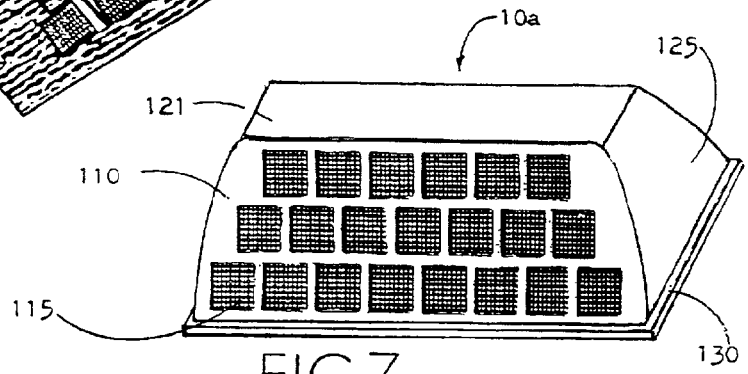
FIG.7
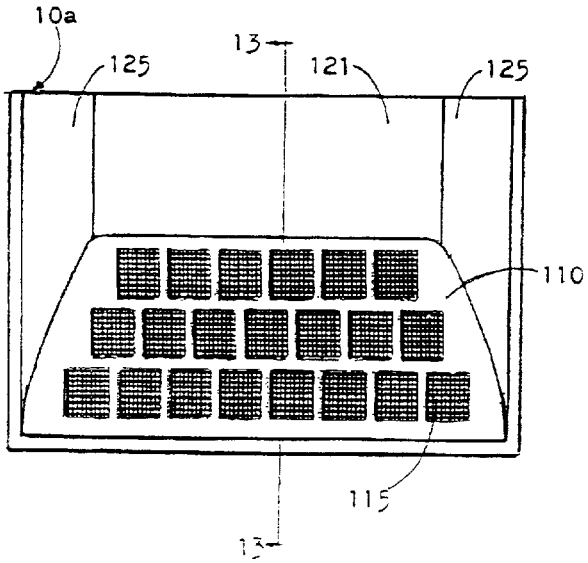
FIG.8
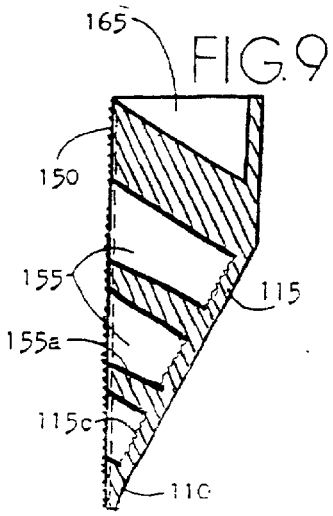
FIG.9

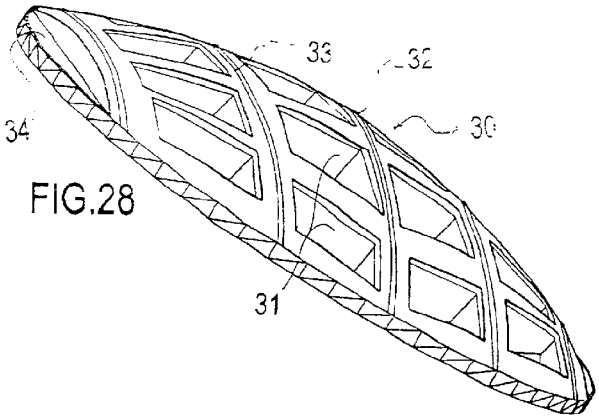
FIG.28
FIG.25
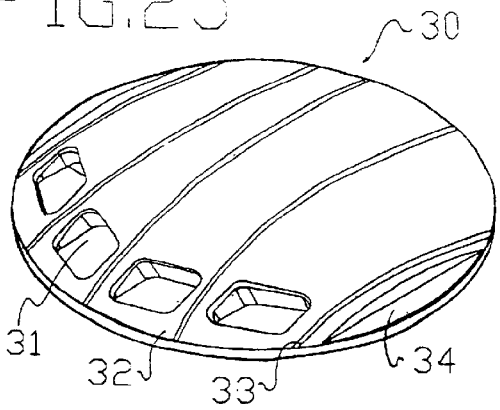
FIG.26
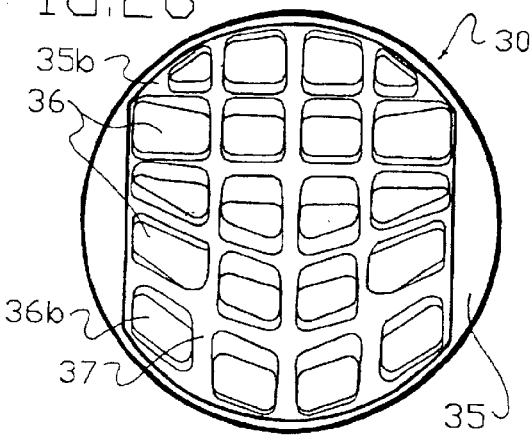
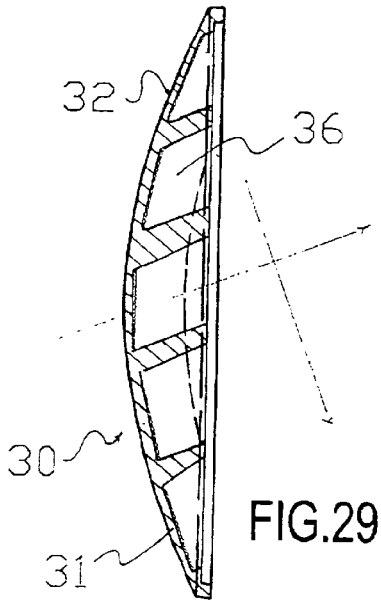
FIG.29
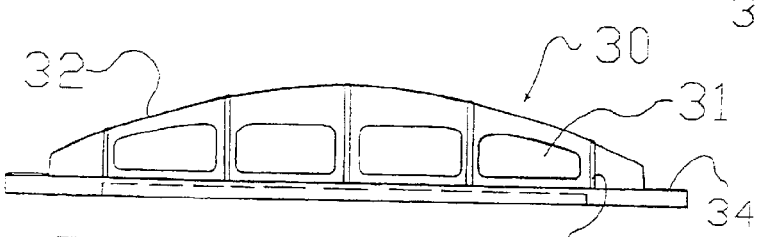
FIG.27

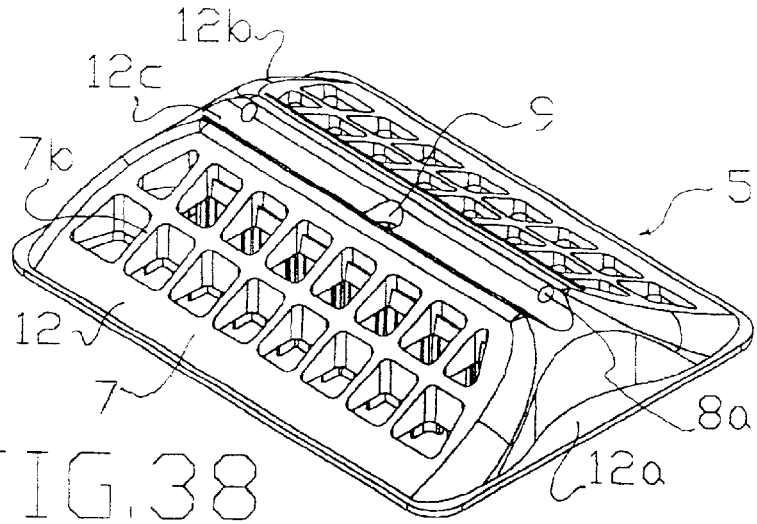
FIG.38
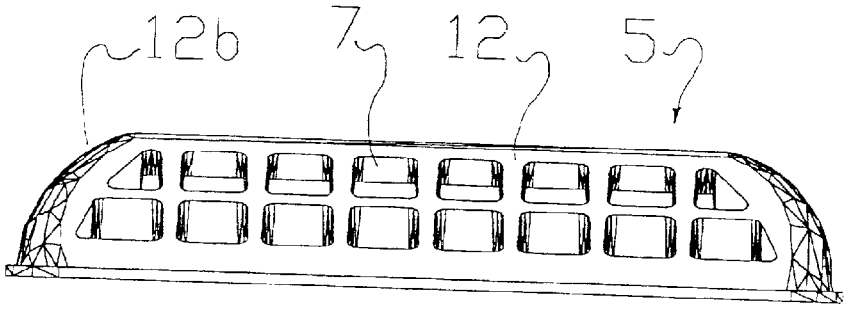
FIG.39
FIG.40
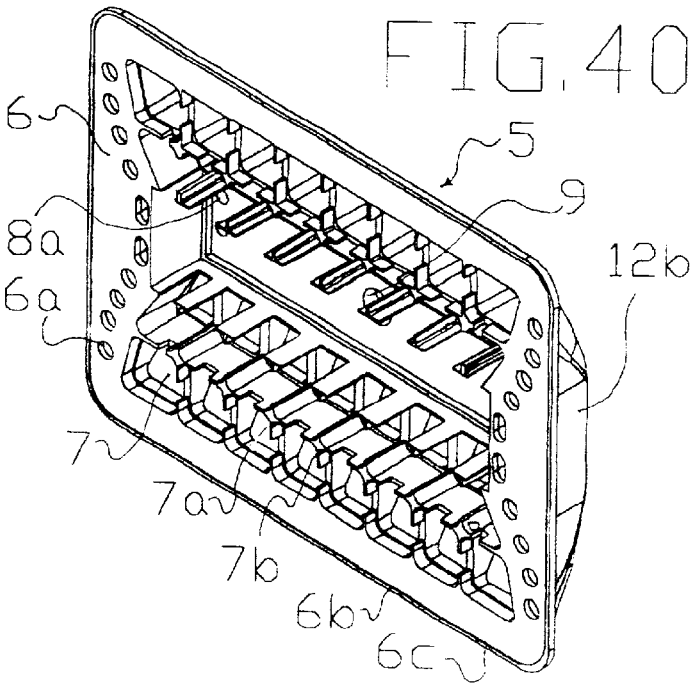

FIG. 41
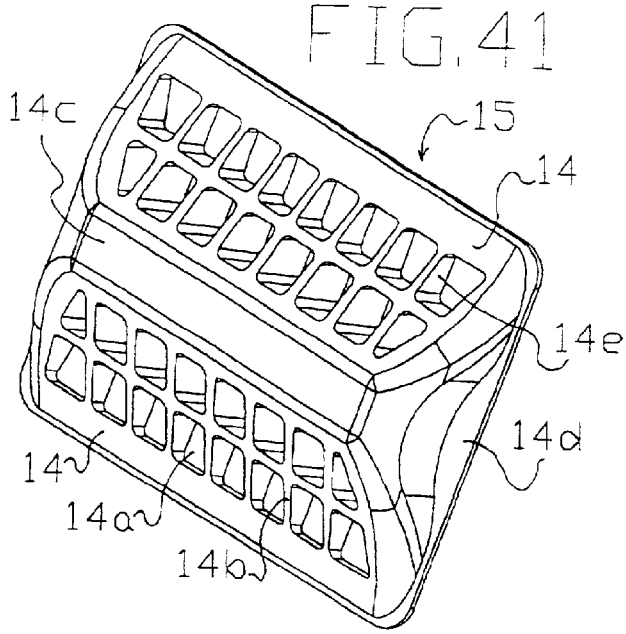
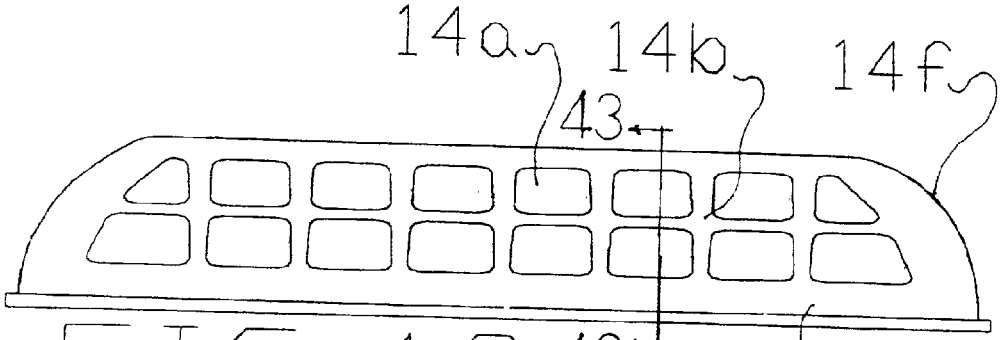
FIG. 42
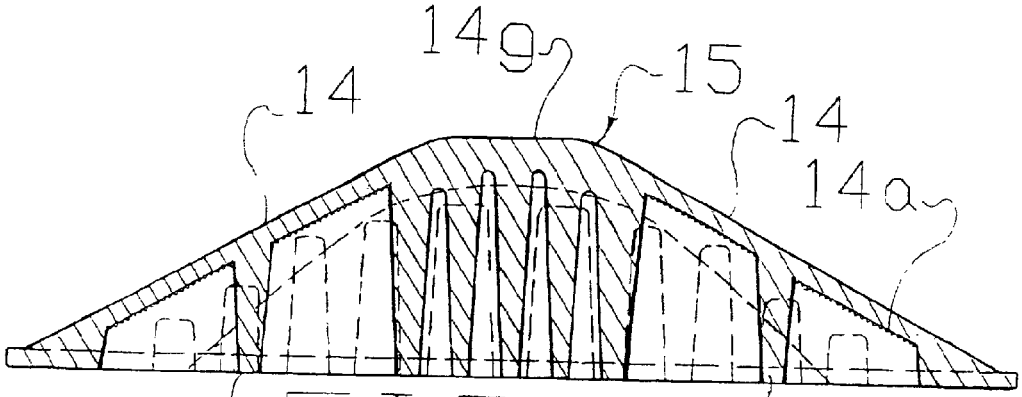
FIG. 43

ONE PIECE REFLECTIVE PAVEMENT MARKER AND METHOD OF MAKING

This is a CONTINUATION IN PART of application, Ser. No. 09/385,091 filed on Aug. 30, 1999 now U.S. Pat. No. 6,334,734, CIP Ser. No. 09/634,430 filed on Aug. 8, 2000 now U.S. Pat. No. 6,698,972, CIP Ser. No. 09/880,780 filed Jun. 13, 2001 AND a CIP of international Application No. PCT/US00/22449 filed on Aug. 15, 2000.

BACKGROUND OF THE INVENTION

1. Field of Invention

This invention relates to the process of forming roadway markers that are used for traffic lane delineation, in particular, to markers with enhanced reflectivity and abrasion resistant.

2. Related Art

Roadway markers are adhered to pavements along centerlines, edge lines, lane dividers or guardrail delineators. Other roadway markers are used as temporary lane dividers in temporary constructions, detours or prior to permanent marking of newly paved roadways. Since 1965, the most commonly used retroreflective roadway markers are based on Heenan U.S. Pat. No. 3,332,327, Balint U.S. Pat. No. 3,409,344, or Edouart U.S. Pat. No. 4,991,994. Typically, this type of markers are produced in a process consisting of three to five steps: Firstly, injection molding of a thermoplastic shell, either integrally molded with the reflective face, or the reflective faces welded on a corresponding open recesses within the shell. The reflective face, having about 350 or more cube corner reflective elements on each reflective face of the shell. Secondly, either the reflective faces within a shell or the entire inside surface of the shell coated with a reflective metallic sealer by a process known as vacuum metalizing. This metallic sealer needed to seal the cube corner reflective elements so they retain part of their retroreflectivness prior to the next step of filling the shell with a thermosetting resinous material, such as epoxy or polyurethane.

This resinous filler material encapsulate the metalized cube corner reflective elements and give the marker the structural body. Finally, a layer of relatively course sand or glass beads dispersed over the top surface of the filler material prior to solidification of the filler material. This top surface will be the marker's base. Part of the sand particles will remain partially protruding above this planar surface of the marker base, thereby increase the adhesive welding parameter of the base surface. The protruded sand will improve adhesion to substrate, regardless of the type of adhesive used. This type of markers worked well for six or seven months, however, due to poor abrasion and impact resistant of the thermoplastic shell, over 60% of the reflectivity lost thereafter. Also, incompatibility of the shell material to the resinous filler material causes pealing of the reflective face or the shell, thereby losing retroreflectivity. Several attempt were made to improve abrasion resistant of the reflective face. One was the use of thin layer of untempered glass as disclosed in U.S. Pat. No. 4,340,319, another attempt was the use of polymeric coating of the reflective face, as disclosed in U.S. Pat. No. 4,753,548 to (Forrer). These abrasion resistant coating proving to be expensive and tend to reduce retro reflectivity. Other major development in the pavement marker art has been made, this was achieved by eliminate the use of the metalized sealer for the cube corner reflective elements. By dividing the inside surface of the reflective face into reflective cells, each cell will have several cube corner reflective elements, the cells isolated from each other by partition and load carrying walls. The reflective faces welded to corresponding recesses within a hollowed body.

This method is disclosed in U.S. Pat. No. 4,227,772 (Heenan); U.S. Pat. Nos. 4,232,979; and 4,340,319 (Johnson et al); U.S. Pat. No. 4,498,733 (Flanagan). These markers proved to be superior in reflectivity, however, lack of structural strength and poor adhesion cause short life cycle for this type of markers.

This applicant successfully developed two multi-cell reflective roadway markers. One roadway marker utilizes raised rhombic shaped abrasion reducing and load transferring raised ridges, said ridges intercede abrasion elements and impact load. The shell filled with epoxy, hence, the marker body having a base with large wetting parameter for shear and flexural strength, as disclosed in U.S. Pat. No. 4,726,706. The second roadway marker of this applicant, U.S. Pat. No. 5,927,897 developed a mean to increase the abrasion resistant of the reflective face by coating the reflective face with diamond-like film and by having holding pins extending from the partition walls into the body, the holding pins sealed by the filler material; this works very effectively. The entire above reflective pavement markers are incorporated herein by reference in their entireties. The present goal of Applicant is to have a durable roadway marker with high reflectance, abrasion resistant, low cost, marker base area with good welding parameter and one-step process to manufacture said reflective pavement marker.

SUMMARY OF THE INVENTION

This invention provide a novel process of forming one piece raised roadway marker or delineator that comprises a monolithically injection molding the structural body with one or two reflective faces and a base having large area for adhesive welding parameter, thereby provide better adhesion to the pavement and higher resistance to flexural stresses.

The primary objective of this invention is to provide one-step process of manufacturing reflective pavement markers or delineators, while retaining maximum reflectivity and structural strength. Another objective of this invention is to provide a raised roadway marker made of high impact resistant material and abrasion resistant surface with high reflective index.

The present invention further provide a method of making one piece raised roadway marker of any desirable shape and configuration, such as, a marker with truncated body or one piece delineator with two vertically positioned reflective faces, with means to include cube corner reflective elements on the interior of said faces, and having grooved planar base surface.

In accordance with still further aspect of this invention, the marker can be made for one or two way traffic usage; having integrally built-in reflective faces provides durability and cost effectiveness. Also two multi colored parts can be welded together to form multi colored reflective pavement marker.

BRIEF DESCRIPTION OF THE DRAWINGS

The advantages and unique features of this invention will be better understood by reference to the drawings. These drawings are schematics, no scale used. In the drawings:

FIG. 7 is an isometric view of yet another embodiment of one-piece marker of the invention;

FIG. 8 is a plan view of the marker in FIG. 7;

FIG. 9 is a cross section view taken along the line 13—13 in FIG. 8;

FIG. 10 is isometric view of the marker in FIG. 7 showing the base surface and the back portion;

FIG. 11 is an isometric view of a sealing plate for the base of marker in FIG. 7;

FIG. 25 is an isometric view of yet another reflective marker with one reflective side as per this invention.

FIG. 26 is another isometric view of reflective marker of FIG. 25 with multiple reflective cells.

FIG. 27 is an elevation view of reflective marker of FIG. 25 showing one reflective face.

FIG. 28 is a plan view of marker of FIG. 25 showing planar base surface with open ends of hollow cavities.

FIG. 29 is cross section view along line 29—29 in FIG. 26 showing micro cube corner reflective elements.

FIG. 38 is an isometric view of another in-place filled, one-piece reflective marker of the present invention.

FIG. 39 is an elevation view of the reflective marker of FIG. 38.

FIG. 40 is an isometric view of the pavement marker of FIG. 38 showing the base and the fill area.

FIG. 41 is an isometric view of another one-piece pavement marker as per this invention.

FIG. 42 is an elevation view of the pavement marker of FIG. 41.

FIG. 43 is a cross section of the pavement marker taken along line 43—43 in FIG. 42.

DESCRIPTION OF THE PREFERRED EMBODIMENTS

Figure 1:
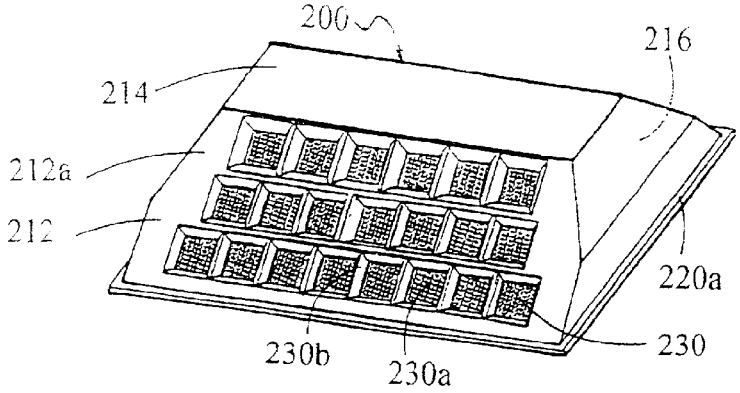
FIG. 1 is an isometric view of one of the preferred one-piece pavement marker of the invention.
Figure 4:
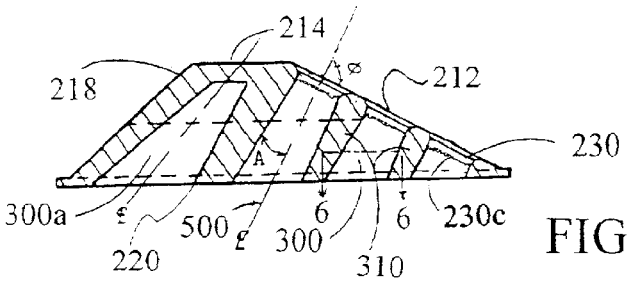
FIG. 4 is a cross section view taken along the line 4—4 in FIG. 2.
Figure 5:
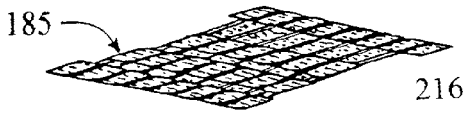
FIG. 5 is an isometric view of a thin plate that can be used to seal the ends of hollow recesses.
Figure 3:
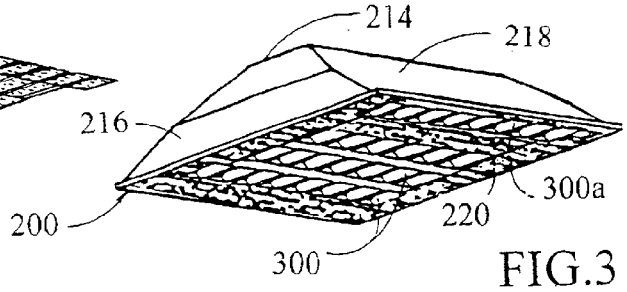
FIG. 3 is another isometric view of pavement marker in FIG. 1 showing the base portion with grooved surface and the end opening for the hollow recesses.
Figure 2:
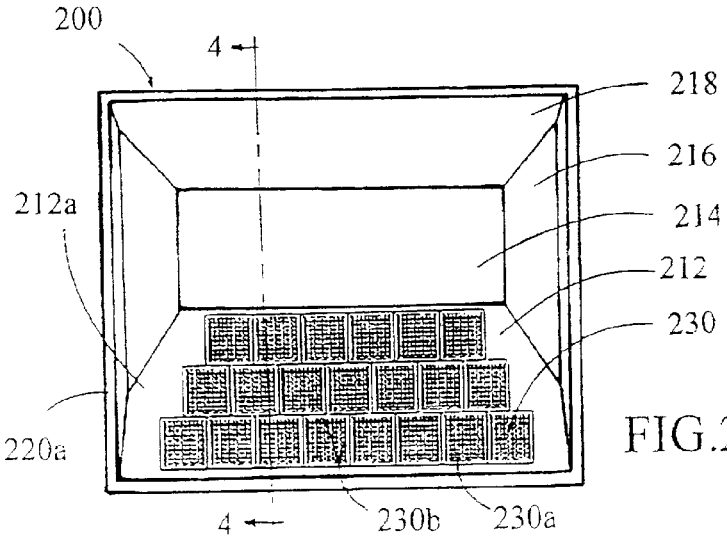
FIG. 2 is a plan view of the pavement marker illustrated in FIG. 1.

Enhanced reflectivity, durability, cost effectiveness and simplified production method can be achieved by eliminating major steps or processes used in previous arts for manufacturing reflective pavement-makers. This invention is satisfying the above-conditions.

This invention eliminate the process of metalizing the reflective face, eliminate the step of welding a backing sheet or a lens mounting sheet to the reflective face; eliminate filling the marker body (shell) with inert filled or fiber reinforced resinous material or welding a unitarily molded block with flattened base to a shell. This invention simply developed a process for monolithically forming a reflective pavement marker in one-stage or two-stage injection molding. This process comprises a mold that provide the means to form: the structural body, the cube corner reflective elements as well as load carrying interior wall means that allow integrally forming of said cube corner reflective elements.

Referring to FIGS. 1 through 6 represent one of the preferred embodiment of a monolithically formed one-piece reflective pavement marker designated by the number 200. Marker 200 is formed utilizing the process of the present invention, which comprises means to integrally injection mold the entire marker 200 including one reflective face 212 in on step.

Marker 200 comprises, a top portion 214, two arcuate sides 216, two inclined planar faces 218 and 212 that are facing opposing traffics, with at least one face (212) is provided with means to integrally form cube corner reflective elements 230*c* on a designated cell like areas 230 within the inside surface of said face 212. Marker 200 also integrally includes textured and grooved planar base surface 220 with extended base portion 220*a* for added adhesion area. Various types, sizes or shapes of cube corner reflective elements can be utilized in this process of monolithically forming marker 200. Preferably, the height of each cube corner reflective element is about 0.0045 to 0.0125 inches. The commonly used standard cube corner elements can also be used.

The inclined planar reflective face 212 integrally has the interior cell like surfaces 230 defined by the load carrying interior wall means 310, which allow integrally forming cube corner reflective elements 230*c* freely protruding within hollow cavity air gaps 300 defined by said wall means 310.

Reflective cells 230 can be of any desired shape or size depending on the positions and shapes of the load carrying interior walls 310. Various reflective cell shapes and cube-corner reflective element sizes can be formed utilizing the method of the present invention.

The following U.S. Patents provide suitable exterior body shape, cell and or cube corner element designs, therefore, all of the following arts are incorporated as reference in their entireties: U.S. Pat. Nos. 4,726,706 and 5,927,897 to Attar and U.S. Pat. No. 3,712,706 to Stam.

The outside planar surfaces of interior cells 230 are integral part of reflective face 212. Since interior cells 230 are defined by load carrying interior walls 310, the angular positions of these walls 310 provide the unobstructed ejection direction for injection molding of said protruding cube corner reflective elements 230*c* as integral part of the structural body of said marker 200. The reflective elements 230*c* within said interior cell 230 are isolated from adjacent cells by said load carrying interior walls 310, said interior walls 310 are tapered outwardly, thereby defining multiple hollow cavity air gaps 300. Hollow cavity air gaps 300 are directly beneath the interior of each cell 230. Each hollow cavity air gap 300 is formed corresponding to the size and interior shape of cell like surfaces 230 with the protruding cube corner reflective elements 230*c*. Hollow cavity air gaps 300 are integrally defined with their centerlines 500 forming an angle (φ) of about 80 to 120 degrees with respect to the outside planar surface of reflective face 212, thereby allowing uninterrupted injection molding process of marker 200 integrally including the cube corner elements 230*c* as well as the load carrying interior walls 310. The load carrying interior walls 310 are tapered forming an angle (A) equal or less than 5 degrees with respect to each hollow cavity centerline 500.

Hollow cavities 300*a* are used when the desired marker is to have only one reflective face, as shown in marker 200. Angular positions of hollow cavities 300*a* can provide the means to form cube corner reflective elements on the inside cell like surfaces of the top portion 214.

Both hollow cavities 300 and 300*a* will be tapered outwardly and open through the textured and grooved planar base surface 220. The load carrying interior walls 310 defining hollow cavities 300 and 300*a* can have fillet corners.

Figure 6:
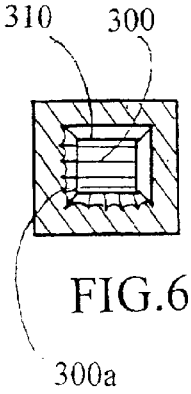
FIG. 6 is a section view along line 6—6 in FIG. 4 showing partly grooved surfaces of a hollow cavity.
Figure 12:
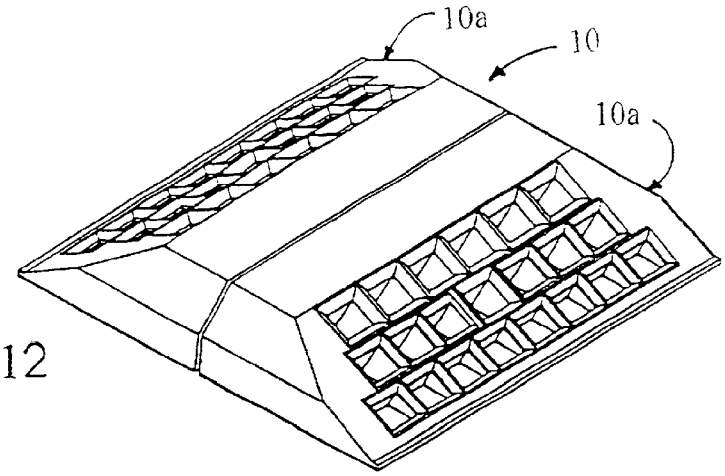
FIG. 12 is an isometric view of two welded markers of FIG. 7.
Figure 13:
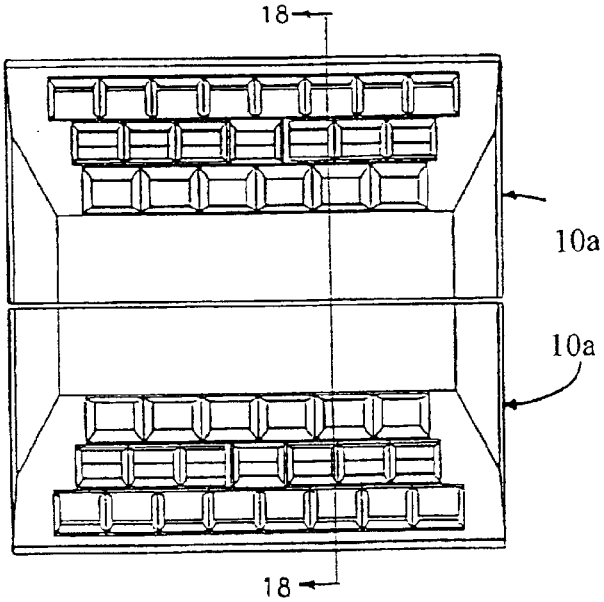
FIG. 13 is a plan view of the marker in FIG. 12.
Figure 14:
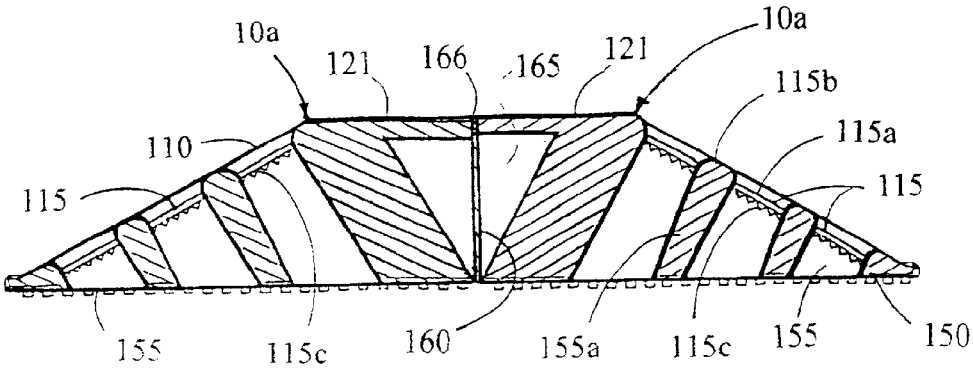
FIG. 14 is a cross section view taken along the line 18—18 of the marker in FIG. 13.

Some of the surfaces of load carrying interior walls 310 and the interior surface of top portion 214 can be formed with textures or arcuate grooves 310*a*, as in FIG. 6, for added reflectivity, surface opaqueness, and enhancing daytime appearance.

Marker 200 can be manufactured in one-step injection molding, either in one-stage or two-stage color injection molding process, utilizing high impact resistance polymeric material.

A simple and efficient process of molding marker 200 can be achieved, by setting the mold's X-axis to be parallel to the planar reflective face 212 or parallel to planar base surface, thereby allowing all centerlines of the hollow cavity air gaps 300 and 300*a* to be closely aligned with respect to the Y-axis of said mold-which is the open and close direction of said-mold. To allow easy ejection cycle after the injection molding of marker 200, a small, outwardly draft angle is provided for the tapered surfaces of said load carrying-interior walls 310, thereby defining said hollow cavity air gaps 300 and 300*a* and providing said uninterrupted injection molding cycles. This method of manufacturing marker 200 can be used to manufacture any pavement marker with the commonly used exterior geometry.

The hot injection molding of the polymeric material into the mold is preferably made through one or two apertures, located on a-portion of the mold forming the base surface of the pavement marker. Thermoplastic such as high impact resistance acrylic, polycarbonate or any other high impact resistance polymers are suitable to be used in this process. Reflective face 212 can have either three raw, two raw or one raw of reflective cells 230, depending on the desired size, shape or height of marker 200 and the reflective cells 230 being used in this process.

For applications in sunny and hot environment, where bituminous hot-melt adhesive may be used, to agglutinate any marker to the roadway, the low melting point of such adhesive material may lead to adhesive failure known as cookie cutter effect, where a marker agglutinated to the pavement, may be forced by traffic impact load to move away from it's intended location on the roadway.

The science of material welding teach us that one of the primary variables to good adhesion of two surfaces is the total surface area to be wetted by the adhesive (welding) material, this area can be called the welding parameter, therefore, we can improve adhesion of marker 200 to a substrate, perhaps more effectively than the previous arts. This improvement in welding parameter can be achieved by using one of various arcuate shaped recesses within the base surface, each having discontinuous length. The grooves are perpendicular to traffic direction.

Each groove can have length of about an inch or less and textured surface, preferably by sand blasting the corresponding part of the tooling.

The depth of such grooves should about 0.04 to 0.10 inches. The length of each discontinuous grooves is about an inch, with textured surface. In addition, planar base surface 220 can have an integrally extended portion 220*a*, which extends beyond the periphery of marker body for added adhesive grip. Yet another mean to improve the adhesive welding parameter of the grooved planar base surface 220 is by capping the open ends of hollow cavities 300 and 300*a* by a corresponding shaped plate 185 with textured and grooved'surface. Plate 185 can be used to plug a designated recessed area that can be provided within the base surface 220, such recessed area will include all the openings of the hollow cavities 300 and 300*a*, thereby allowing sonic welding of said plate 185 to said recessed area of the base 220.

FIGS. 41 through 43 shows another reflective marker 15 that can be fabricated in accordance to the one-step process of present invention. Marker 15 can have two reflective faces 14, each with integrally formed, multiple reflective cells 14*a*. Each of cells 14*a* integrally having multiple cube corner reflective elements. Each cells interior inside a hollow cavity defined by multiple load carrying partition walls 14*b*.

The centerlines of the hollow cavities are near perpendicular to the planar base surface 16. Preferably, various sizes of the reflective cube corner elements as described in U.S. Pat. No. 3,712,706 to Stamm can be used, to minimize any ejection problems during fabrication.

In other applications where the desired marker to have two reflective faces with one or two colors, shorter body depth, lower height or maximum welding parameter at the marker base area. Embodiments such as marker 10 and 10*a* of FIG. 7 through FIG. 14 can be formed in accordance to the method of the present invention.

FIG. 7 through FIG. 14 illustrate marker 10 comprises of two integrally formed near identical shaped marker 10*a*, welded or glued together. Marker 10 can have either transparent or partially pigmented body. Each marker 10*a* integrally comprises one inclined planar reflective face 110, a top portion 121, two arcuate sides 125, a planar rectangular base surface 150 with textured discontinuous grooves, said base surface 150 can have an integrally extended base portion 130 which extends beyond the periphery of the top portion of marker body, and back portion 160 forming perpendicular angle with respect to the planar base surface 150, said back portion 160 includes beaded surface and hollow cavities 165.

Various bead shapes or edges can be incorporated on the back portions 160, thereby fusing said back portions to each other during sonic welding.

The planar reflective face 110 integrally has interior cell like surfaces 115 with means to integrally form multiple of cube corner reflective elements 115*c* protruding from said interior cell surfaces 115. The interior cells 115 are open within hollow cavity air gaps defined by the load carrying interior wall means 155*a*. The hollow cavity air gaps 155 are open at the base surface 150. The centerline of each hollow cavity air gaps 155 forms an angle ($\alpha$) of about 80 to 120 degrees with respect to the outside surface of reflective face 110. Each hollow cavity 155 separated from each other by means of outwardly tapered load carrying interior walls 155*a*.

Figure 35:
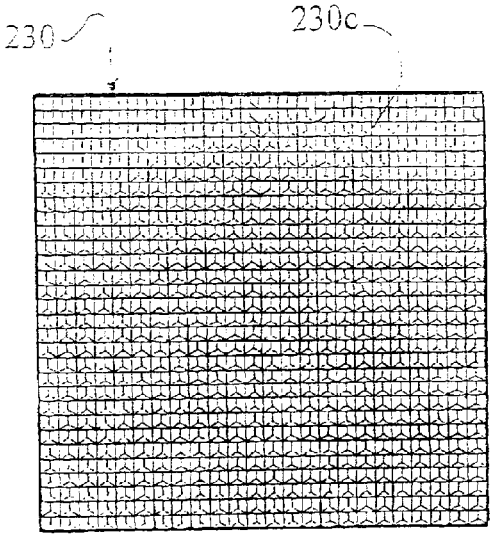
FIG. 35 is plan view of a rectangular reflective cell showing multiple micro cube corner reflective elements.
Figure 36:
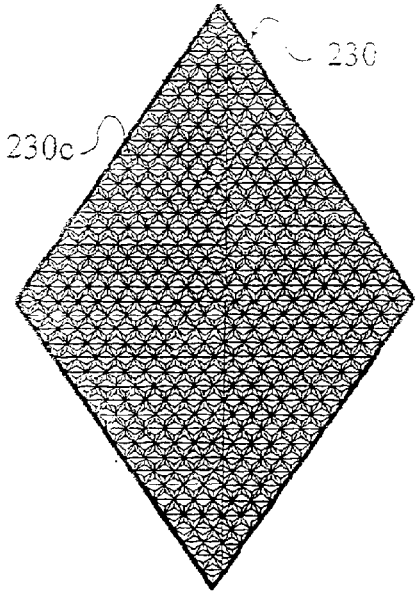
FIG. 36 is another preferred rhombic shaped reflective cell with deferent type of micro reflective elements
Figure 37:
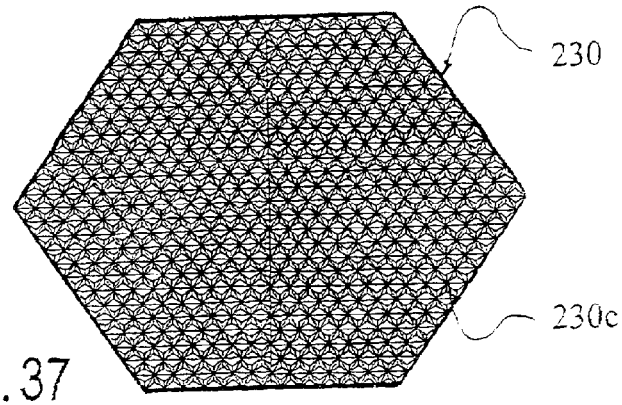
FIG. 37 is yet another shape of a reflective cell that can be used for markers of the present invention.

It can be shown that marker 10 can have any commonly used shape or size and the reflective face can have either one raw or multiple rows of reflective cells, each cell having either hexagonal, rectangular, rhombic shape, as shown in FIGS. 35 to 37. When additional welding parameter (area) is needed for the base surface 150, the entire open ends of hollow cavities 155 can be capped by correspondingly shaped plate 180, as in FIG. 11, which can be welded onto a corresponding size and shaped recessed area that can be provided within the base surface 150. Marker 10 can be formed by means of welding the backsides 160 of two identical markers 10*a*.

The two markers 10*a* can be integrally injection molded with thin wedge connection 166. Wedge 166 can be tore apart so that, two markers 10*a* with dissimilar colors can be welded at the corresponding back sides 160, forming marker 10. An alternative injection molding means can form each part 10*a* having a transparent reflective face segment 110 and the remaining segment of part 10*a* to be opaque. Marker 10 is manufactured by means of an injection molding process, integrally including the two parts 10*a*. This process can form each part with one or two dissimilar color segments.

The various embodiments according to the process of this invention can be provided with means to enhance durability and abrasion resistant of the exterior surface by applying a wear resistant film. Preferably applying this hard film either by using existing, off the shelf liquid polymeric dip coat or by means of either reactive sputtering, utilizing pressure controller for accuracy, ion beam deposition methods or plasma enhanced chemical vapor deposition methods. This hard coat can be deposited on the reflective faces or the entire outside surface of the marker, said film can be a hard carbon film, silicon dioxide, aluminum oxide, and aluminum trioxide or titanium oxide film. Various coating methods can be utilized using hybrid plasma enhanced chemical vapor deposition processes; ion beam assisted'sputtering or reactive sputtering.

In one of the plasma enhanced chemical vapor deposition methods, the carbon film is deposited on the surface of the marker by plasma decomposition of an alkane such as normal butane, methane, etc. with two, parallel spaced pure carbon electrodes, each powered by radio frequency power source, in a vacuum deposition chamber.

Under these conditions, the deposition of very hard carbon film can occur with good adhesion to marker surface. The deposition of carbon film can be achieved in one or multi layers within the same evaporative cycle, so that the first layer can have minimum hydrogen content, thereby adhering tenaciously to the substrate surface, that is to the surface of the pavement marker. Some belt driven or sequel tools, such as Novellus or Rohwedder AG methods may be available for semi-continuous production coating. Alternatively, a hard and transparent aluminum oxide, silicon dioxide or titanium oxide film can be deposited on the reflective marker surface by using reactive sputtering assisted with pressure controller that would maximize the deposition rate allowing much faster rate and consistant rate of deposition of the a hard carbon, aluminum oxide or titanium oxide film with good adhesion to marker surfaces.

Another alternative means for a multi-layer hard carbon film deposition with good adhesion to substrate and without any polymeric prime coat is by ion beam sputtering in one or two stages, thereby having a soft carbon prime coat for good adhesion followed by hard carbon film.

To achieve maximum adhesion of such hard coating, the surface of the marker may be cleaned either chemically or with ion etching prior to applying the carbon film.

By gradually lowering the hydrogen pressure in the chamber and subsequently reintroducing hydrogen gradually to the plasma decomposition process of a gas, such as argon gas, a buffer film coating of carbon can be attained, immediately followed by a harder carbon film coat with higher hydrogen content thereafter to be deposited on the marker surface.

The process of the present invention can also be utilized to make other roadway markers, such as barrier delineators as well as temporary markers and mini marker for insertion into metal-based markers, such as used in snowy regions.

Figure 15:
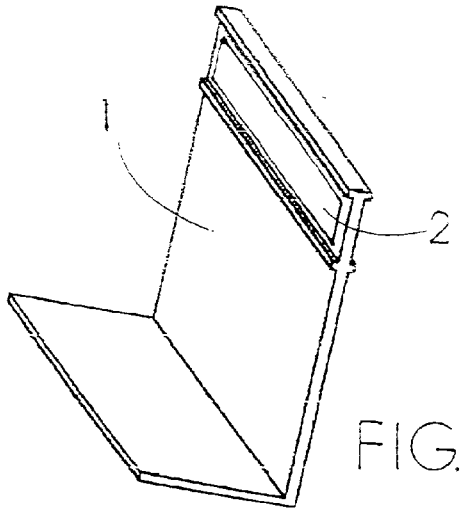
FIG. 15 (FIG. Prior Art 15) is an isometric view of conventional slurry seal delineator.

FIG. 15 (Prior Art 15) illustrates a schematic view of a typical L shaped delineator. This delineator made having either extruded or injection molded body 1, and two reflective strips 2 attachments, each with multiple cube corner reflective elements, said strips 2 adhered onto the top part of said body.

Figure 16:
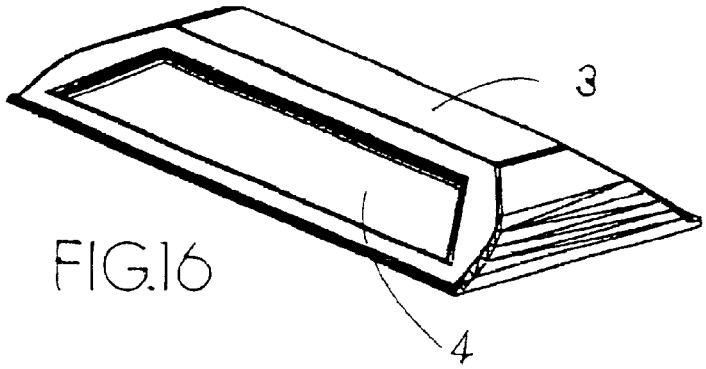
FIG. 16 (FIG. Prior Art 16) is schematic view of a temporary pavement marker.

FIG. 16 (Prior Art 16) illustrates another delineator or temporary marker. This type of temporary marker is usually made of two parts, a body with multiple of hollow cavities 3, and at least one reflective plate attachment 4.

The process of the present invention can integrally form the entire delineator or temporary roadway marker's structural body including the cube corner reflective elements by means of one single injection molding cycle. Such delineator or temporary roadway marker made of one type or two types of high impact and tear resistant thermoplastics.

At least the reflective face portion integrally made of optically clear thermoplastic, including the cube corner reflective elements.

The illustrated embodiments in FIGS. 17 through 24 exemplify few delineators and temporary markers that can be manufactured according to the process of present invention.

Figure 17:
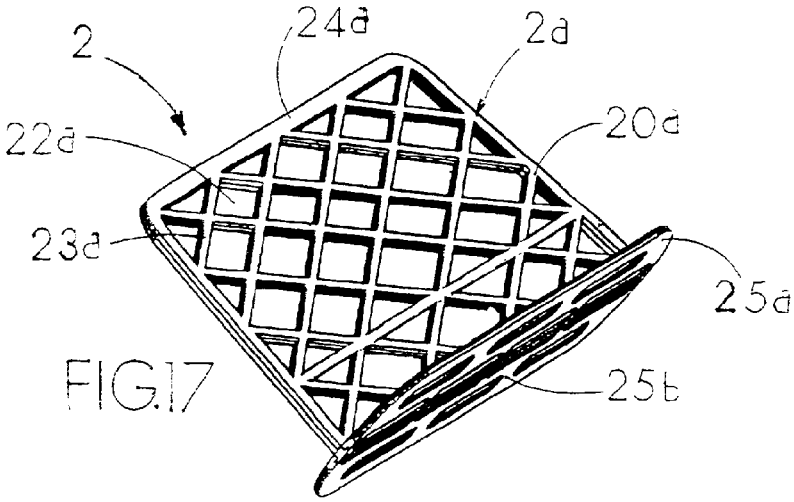
FIG. 17 is an isometric view of preferred delineator made in accordance to the invention.
Figure 17B:
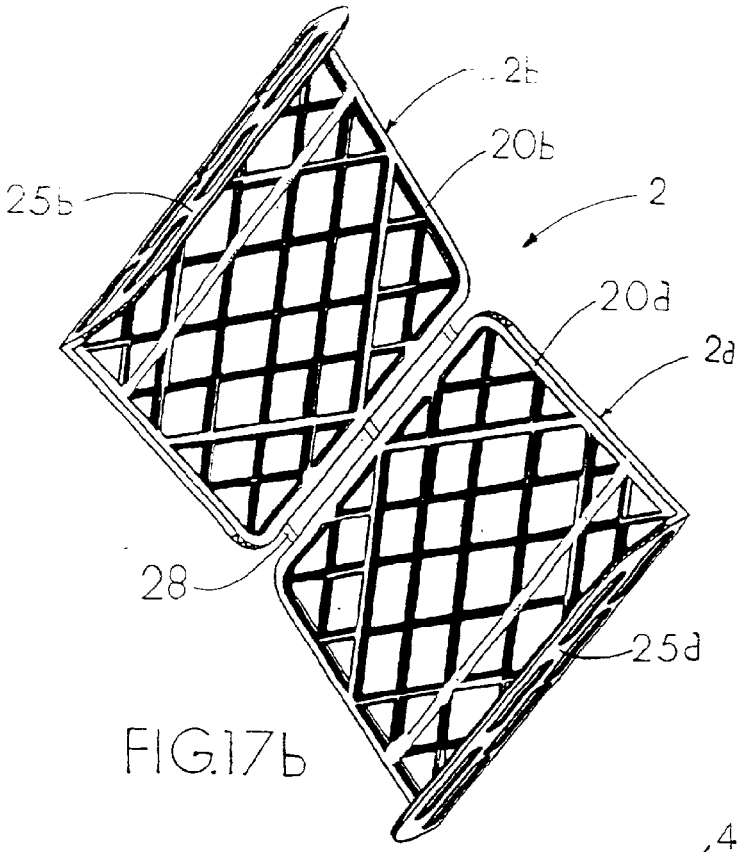
FIG. 17*b* is isometric view of delineator of FIG. 17 before sonically welding the two sides.

FIGS. 17 and 17*b* show one of the preferred embodiments of a delineator 2. Delineator 2 is manufactured using means in accordance to the present invention. FIG. 17*b* in particular shows the two sides 2*a* and 2*b* of delineator 2, within the proximity of their position while being ejected during the injection molding process of said delineator 2. Each side 2*a* comprises a planar base portion 25*a* with grooves and a vertically positioned reflective face portion 20*a*. Base portion 25*a* is planar and can have few holes pierced through its surface, said surface is near perpendicular to face portion 20*a*. Face portion 20*a* is having two distinct sides, an interior side and exterior side. Both sides of face portion 20*a* are integrally partitioned into multiple of cell like shapes 22*a*. Cells 22*a* having planar surfaces on the exterior side, said planar exterior surfaces separated from each other by raised load carrying partitions walls 23*a*.

Cells 22*a* have interior surfaces with means for including and integrally forming multiple of cube corner reflective elements. The interior surfaces of the cells 22*a* are isolated from each other by the interior extension of partition walls 23*a*, said interior extension of walls 23*a* having wedge shaped top segment, means for allowing said partition walls to be sonically welded to the corresponding walls of the delineator's opposing side 2*b*.

Side 2*a* can be formed having periphery walls 24*a* defining the face portion 20*a*, and providing means to interlock with the corresponding walls 24*b* on the integrally formed opposite side 2*b*. Periphery walls 24*a* can also be integrally formed with textures or beads on its inside surface to partially fuse with said opposite walls 24*b* on side 2*b* of delineator 2.

The fusion of periphery walls 24*a* and 24*b* as well as partition walls 23*a* and 23*b* can be achieved by means of sonically welding the two sides 2*a* and 2*b* of the delineator 2. Similarly, side 2*b* comprises top face portion 20*b*, and a planar base portion 25*b*. The face portion 20*b* having similar cell like shapes 22*b* corresponding to the opposing side 2*a* of delineator 2.

Cells 22*b* are isolated from each other by the load carrying raised partition walls 23*b*. Each cell 22*b* having an interior surface with means to integrally include multiple of cube corner reflective elements.

The interior portions of the partition walls 23*b* are integrally formed with means for having the top segment fuse to the corresponding wedge shaped top segments of walls 23*a* of side 2*a*.

Sides 2*a* and 2*b* are integrally injection molded with wedge shaped ties 28, said ties 28 can be folded or split apart, thereby allowing the two sides 2*a* and 2*b* to interlock and/or sonically welded to each others interior side. After the two sides 2*a* and 2*b* are interlocked or welded, air gaps will be retained between the inside surfaces of each two opposing cells 22*a* and 22*b*, thereby allowing maximum retro reflectivity on two opposing traffic paths, via the freely protruding cube corner reflective elements within the interior surfaces of said cells 22*a* and 22*b* of sides 2*a* and 2*b*.

Various types of interlocking means, welding methods, and types of cube corner reflective elements and method of forming the same are available and can be incorporated in the process of forming delineators or temporal roadway markers or low profile markers, in accordance to the present invention. Descriptions of suitable cube corner reflective elements are provided in U.S. Pat. No. 3,712,706 to Stamm; U.S. Pat. No. 3,922,065 to Schultz, and U.S. Pat. No. 4,588,258 to hoopman, all of which are incorporated herein by reference in their entireties.

Any desired marker size or geometric shapes of each reflective cell can be incorporated in the injection molding process of forming the marker in accordance to present invention.

Figure 18:
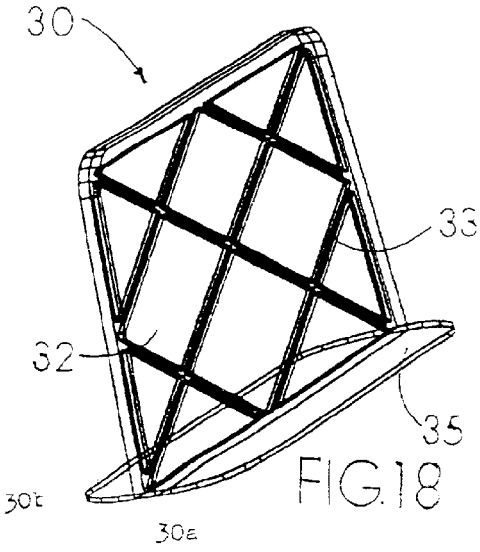
FIG. 18 is an isometric view of barrier-delineator, manufactured in accordance to the invention.

FIGS. 35 thru 37 shows various reflective cell shapes and sizes of cube corner reflective elements. FIG. 18 illustrate an isometric view of another preferred delineator 30, said delineator 30 can be injection molded in one piece with two sides 30*a* and 30*b*, in accordance to the process of the present invention. Delineator 30 has fewer partition walls 33 on each side, thereby allowing the formation of larger reflective cells 32 on both sides 30*a* and 30*b*, of said delineator 30. Each side 30*a* and 30*b* has a planar and grooved base surface 35.

Figure 19:
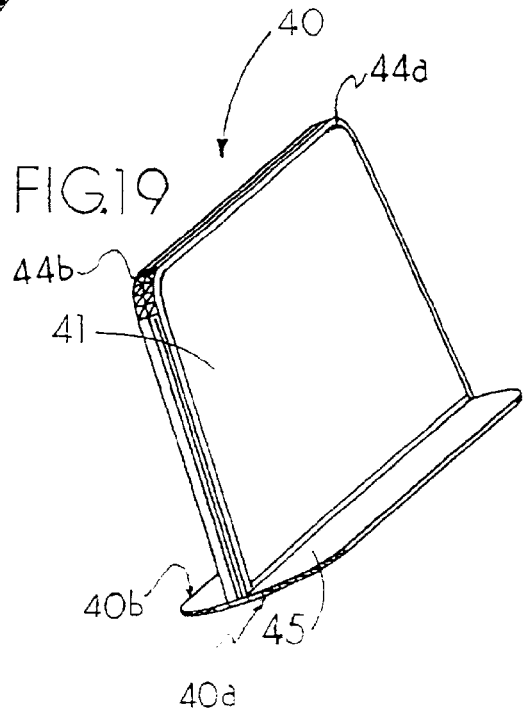
FIG. 19 is isometric view of another barrier-delineator based on the present invention.
Figure 22:
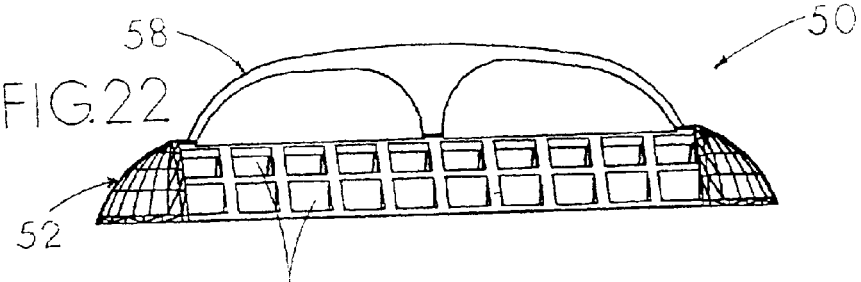
FIG. 22 is an elevation view of the delineator of FIG. 20 showing both top and lower body.

FIG. 19 shows an isometric view of yet another delineator 40, preferably for use on the top or sides of concrete barriers, such barriers are commonly used to separate two directional traffics.

The two sides 40*a* and 40*b* of delineator 40 have no interior partition walls. Each side has a reflective portion 41, integrally including means to form cube corner reflective elements on the interior surface, and grooved planar base surface 45. By sonically welding the two integrally connected sides 40*a* and 40*b* at the beaded interior surfaces of the periphery walls 44, thereby delineator 40 is formed.

Figure 20:
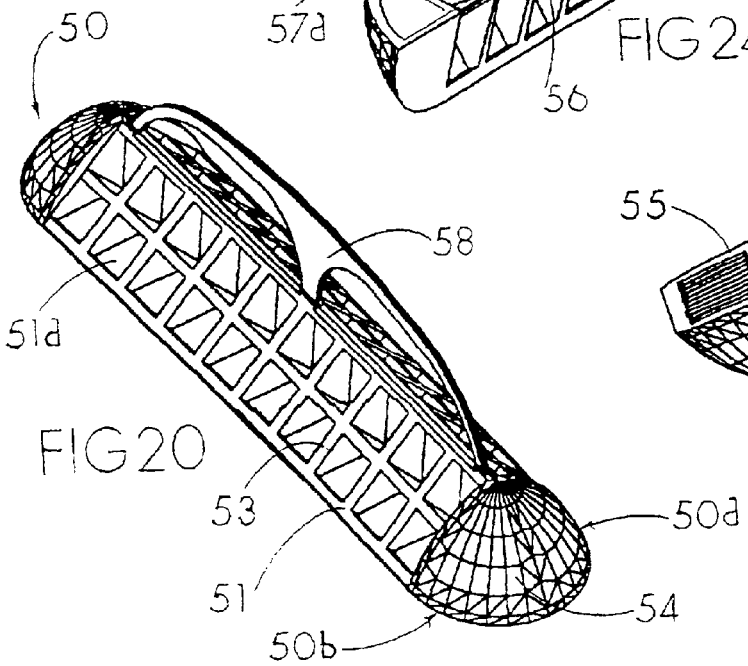
FIG. 20 is isometric view of a dual use delineator temporary marker as per this invention.
Figure 21:
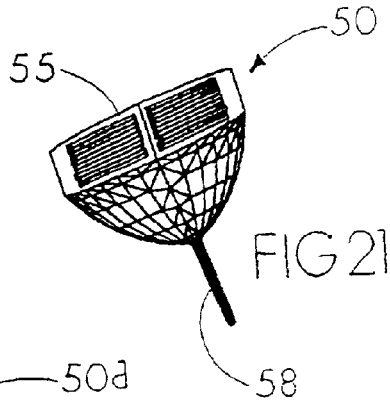
FIG. 21 is another isometric view of marker in FIG. 20 showing the base surface.
Figure 32:
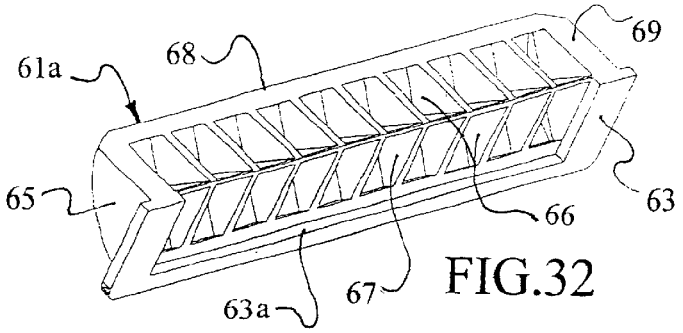
FIG. 32 is an isometric view of one part of the reflective marker of FIG. 30 showing back and base area.
Figure 31:
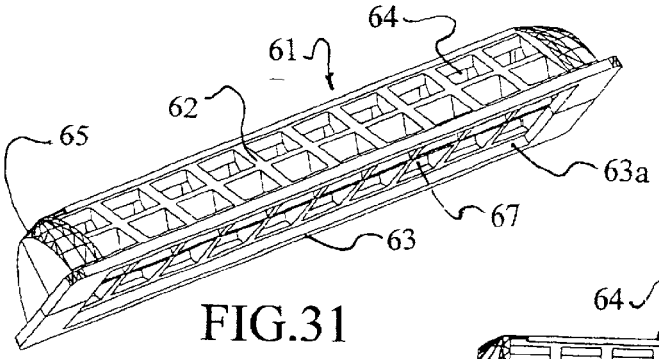
FIG. 31 is another isometric view of the reflective marker of FIG. 30 showing the base surface.
Figure 34:
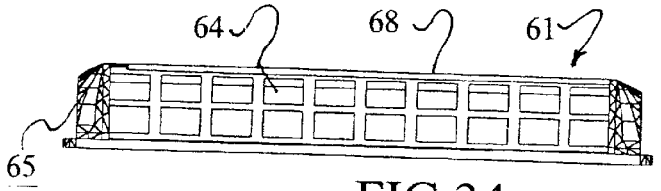
FIG. 34 is a cross sectional view of the reflective marker of FIG. 30 taken along line 34—34 in FIG. 33.
Figure 30:
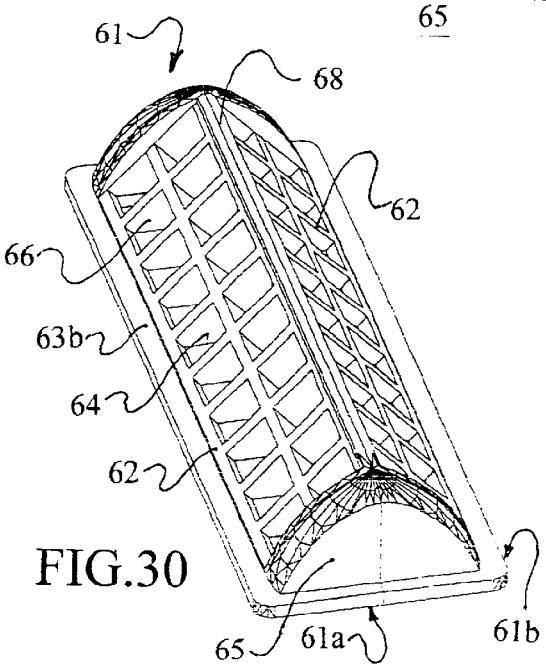
FIG. 30 is an isometric view of yet another preferred low profile reflective marker of present invention.
Figure 33:
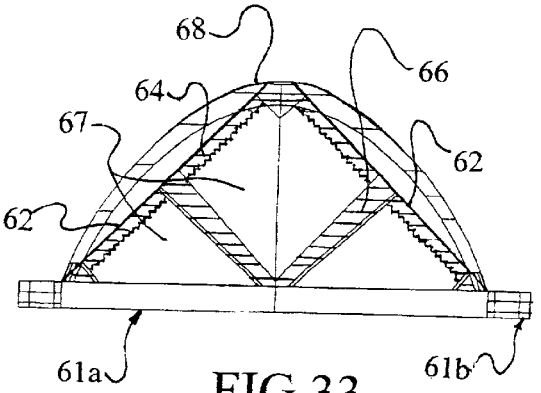
FIG. 33 is an elevation view of the reflective marker of FIG. 30.

FIGS. 20 through 24 illustrate yet another novel structure that can be manufactured using the means in accordance to the process of present invention. In FIG. 20, there is shown a preferred embodiment of a temporary roadway marker 50 integrally formed in accordance to the present invention.

Temporary marker 50 comprises means for integrally injection molding the two sides 50*a* and 50*b* near identical to each other. Each side is having an upper segment 58 that resemble a handle bar, which will be called handle bar 58 from hereon, and a lower body 52.

Body 52 is having two arcuate sides 54, an inclined planar face 51 with two rows of multiple reflective cell like areas 51*a* on the interior surface of said planar face 51. This two rows of cell like interior areas 51*a* are provided with means to integrally include multiple cube corner reflective elements, said interior surfaces of cells 51*a* are open within hollow cavity air gaps 56 and 56*b* defined by means of load carrying partition walls 53. Body 52 also integrally includes a backside 57, said backside 57 with beading means for sonically welding the opposing sides 50*a* and 50*b*, thereby forming temporary marker 50. The two sides 50*a* and 50*b* are integrally injection molded with a connected thin ties that are provided at the upper periphery of handle bar 58.

Figure 24:
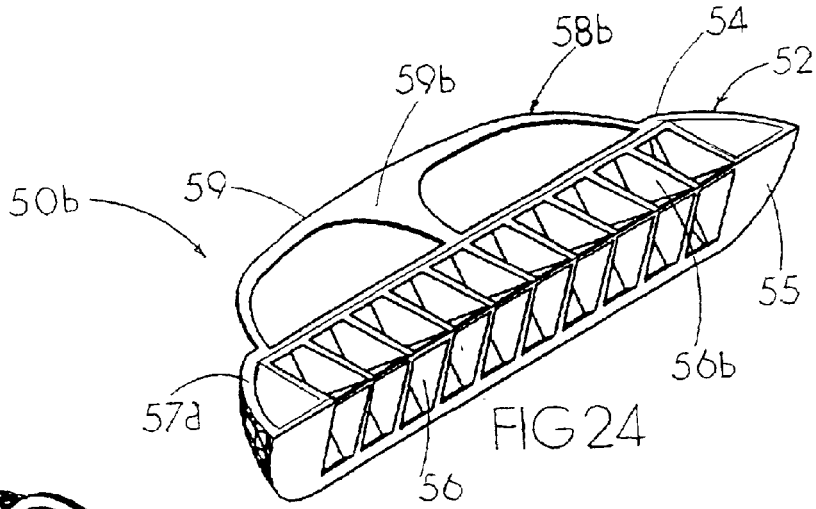
FIG. 24 is an isometric view of one side of delineator of FIG. 20, showing the backside.

FIG. 24 shows an isometric view of one side 50*b* of temporary marker 50, illustrating the planar base surface 55, integrally including one row of multiple hollow cavities 56. Hollow cavities 56 are open directly beneath the lower row of cells 51*a*, thereby allowing means to form cube corner reflective elements on the interior of said lower row of cells 51*a*. Also shown in FIG. 24, the backside 57, which consist of two segments 57*a* and 58*b*. Segment 57*a* is the backside of lower body 52, and the upper segment 58*b* is the backside of the handle bar 58 of side 50*b* of said temporary marker 50.

Segment 57*a* having textured planar surface that can be provided with beads so that it can be welded to the opposite side 57*b*, also shown multiple of hollow cavity air gaps 56*b*, which are open through said segment 57*a*. Hollow cavities 56*b* are open directly beneath the upper row of reflective cells 51*a*, thereby providing the means to integrally form multiple of cube corner reflective elements on said inside surfaces of upper row of cells 51*a*.

The upper segment 58*b* is the interior surface of handle bar 58. Segment 58*b* is also provided with means to integrally forming multiple of cube corner reflective elements bounded by raised periphery edges 59, said periphery edges 59 provide means to weld the two sides of handle bar 58, of said marker 50. The out side planar surfaces of the cells 51*a* can be either continuous part of the inclined planar face 51, or slightly recessed bellow the outside extensions of the load carrying walls 53. When the two sides 50*a* and 50*b* are sonically welded fusing the textured or beaded backsides, an air gaps will be retained, both in the upper handle bar 58 and the lower body 52, thereby providing retro reflectivity, both from the handle bar segment and from the lower body segment, and on two opposing traffic paths.

Figure 23:
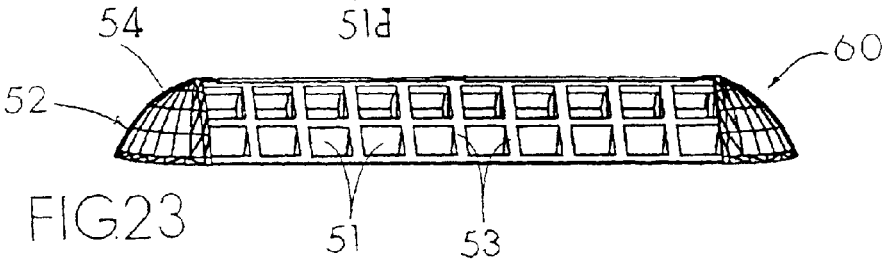
FIG. 23 is an elevation view of delineator of FIG. 20 without the top portion.

Both, the handle bar segments 58 and the lower body 52 can be integrally formed from highly transparent and resilient plastic. Temporary marker 50 can also be injection molded without the handle bar segment 58, thereby having a low profiled mini reflective marker with a height of about 0.4 to 0.5 inch and an inclined planar face 51 forming an angle of about 28 to 45 degrees with respect to the base surface 55, as shown in FIG. 23 with a designated temporary marker number 60 or as mini marker 61, as shown in FIGS. 30 thru 34. Mini marker 61 is designed for use either as a low profile reflective marker with excellent retro-reflective faces, reflective marker in a recessed pavement slots or as insert in snow plow able metal casing. The primary structural support for mini marker 61 is multiple load carrying interior walls 66.

Marker 61 is injection molded using the process of present invention. Marker 61 comprises of two identical parts 61*a* and 61*b*. Each part having an inclined planar reflective face 62 with two rows of multiple reflective cells 64, two arcuate sides 65 with abrupt vertical ends, a base 63 that includes the open ends of the lower row of hollow cavity air gaps 67 and an extended portion 63*b* for added adhesion area, a vertical back portion 69 with the open ends of the upper row of hollow cavity air gaps 67 and a top portion 68 connected by thin ties to the corresponding opposite half.

The top portion 68 can be variable in width, depending on the size of the marker 61. Welding the two corresponding back portions 69 forms said marker 61. Load carrying interior walls 66 define the interior shapes of cells 64 and the hollow cavity air gaps 67.

The base area 63 can have a recessed portion 63*a* for capping and sealing the open ends of hollow cavity air gaps 67 with a corresponding size, thin and textured polymeric sheet.

Various combinations of size, height or geometric shape for markers 10,30,40, 50, 60 or 61 can be incorporated in the injection molding process of the present invention.

Preferably markers 50, 60 or 61 can have the height of the lower body 52 about 0.40 to 0.60 inches, with a base having width of about 4.0 to 5.0 inches and depth of about 2.0 to 3.0 inches.

The upper handle bar 58 of marker 50 can have various shapes and a height of about 1.00 to 1.50 inches, with overall thickness of about 0.05 to 0.20 inch. Pressure sensitive adhesives can be added to the base of all delineators or roadway markers for quick installation of said roadway markings. In some construction applications where the need for delineator is only for few days and for one-way traffic, one side of delineator 10 or marker 50 can also be used to be effective in such applications. FIGS. 25 thru 29 illustrate another novel, spherically shaped reflective pavement marker 30 that can be injection molded in one-step, either in one stage or two stages, utilizing the manufacturing process of the present invention. Pavement marker 30 comprises: a spherical top surface 32 with multiple parallel lined raised ridges 33, two recessed and near vertical grip sides 34, a textured planar base surface 35 that include the open ends of multiple hollow cavity air gaps 36 and 36*b* which are defined by means of multiple load carrying interior walls 37. The pavement marker spherical top surface 32 further includes, multiple, planar, inclined reflective cells 31. Either all of cells 31 or only the two, front and back rows can be provided with means to form, on the cells inside surfaces, multiple cube corner reflective elements protruding within the defined hollow cavity air gaps 36 and 36*b*.

Marker 30 can be injection molded in one stage cycle with transparent polymeric material or can be manufactured in two-stage injection molding cycle having first transparent polymer injected to fill the optical portions within cells 31, immediately followed by an opaque polymeric material to fill the remaining body.

When the two-stage injection molding process is used, the outside appearance could be similar to the marker 30, as shown in FIGS. 25 and 27.

Alternatively, if more transparent polymer is used or no opaque polymer injected in the second stage, then multiple of cells 31 can be formed with means to integrally include multiple cube corner reflective elements, thereby having retro reflectivity from multiple rows of cells 31 within the spherical surface 32 of marker 30, as shown in FIGS. 28 and 29. Various geometric shapes and number of rows of hollow cavity air gaps can be used within marker 30. The intersection corners of all load carrying interior walls 37 can be fillet to allow smooth injection molding cycles.

The mold for injection molding marker 30 will have an open-close path parallel to the y-axis, as shown in FIG. 29. This y-axis will also be near parallel to the centerline of each hollow cavity air gaps 36 and 36*b* said y-axis can form an angle of about 90 to 120 degrees with-respect to planar base surface 35. The mold also has an x-axis parallel to the x-axis relative to the marker 30 positions, as in FIG. 29.

The load carrying interior walls 37 will have slightly outwardly tapered surface to allow uninterrupted injection molding cycle. When one stage injection molding preferred, part of the inside surfaces of the hollow cavities can have textures or grooves.

FIG. 38 thru FIG. 40 illustrate yet another novel, low cost, in place filled one-piece reflective pavement marker 5 utilizing the present monolithically formed process. Marker 5 is ideally used for an in-place, combining the process of structural filling system for a pavement marker art such as U.S. Pat. No. 3,332,327 to Heenan or U.S. Pat. No. 4,726,706 to Attar with the process of an in-place agglutination to a roadway surface within a one step process. Marker 5 is formed to be low cost, hollowed reflective pavement marker body ideally suited for such an in-place, combined structural filling and agglutination to a roadway surface in one step.

The one-piece marker 5 comprises of two inclined reflective faces 12 each having multiple reflective cells 7, two arcuate sides 12*b* and a sagged, arcuate top surface 12*c*. The sagged top surface 12*c* also includes a centralized open hole 9 for in-place, injection of liquefied resinous structural material and four bleeding holes 8*a*. Both, the sagged top surface 12*c* as well as the bleeding holes 8*a* can control any excess material overflow during the in-place fill process. Each of cells 7 has an inside surface integrally formed with multiple cube corner reflective elements.

Marker 5 has a base surface 6 with planar portion 6*c* that is slightly recessed bellow a thin edge 6*b*, said thin edge 6*b* is formed as periphery to said planar portion 6*c* with intermittent bleeding gabs. Base surface 6 also retain the entire hollowed area beneath the reflective faces 12 and the sagged top surface 12*c*. The interior surfaces of the reflective cells 7 are integrally formed with multiple cube corner reflective elements. Cell 7 are defined and separated from each other by thin partition walls 7*b*.

Partition walls 7*b* has a lower region that is slightly wider and integrally provide a periphery region 7*a* around each reflective cell 7, thereby allowing a correspondingly shaped, thin protective plastic sheet to be welded onto each periphery region 7*a* slightly above the apexes of the cube corer reflective elements within each of cells 7. This tight plastic sealing sheet must protect the inside of each reflective cell 7 prior to the material fill process. Each partition post 7*b* also has opening of various depth, at the center portion, allowing free flow of the fill material injected into the pavement marker during in-place agglutination and filling process.

FIGS. 41 through 43 illustrate another monolithically formed one-piece reflection pavement marker 15. Mark 15 is one-piece with a planar top 14*c*, two curved sides 14*f* each with recessed grip area 14*d*, two opposing, planar reflective faces 14, and planar base surface 16 with multiple load carrying partition walls 14*b* defining the open ends of hollow cavity air gaps 14*e*. The insides of cell like surfaces 14*a* are monolithically fabricated with multiple cube corner reflective elements. The centerlines of each hollow cavity air gap 14*e* form angle of about 90 to 110 degrees with respect to the planar base surface.

The present invention includes within its scope a method for making the monolithically formed reflective pavement marker comprising the steps of:

selecting the pavement marker shape, polymers to be used, type and size of the cube corner reflective elements to be used, body shape, sizes of reflective cells used and the injection molding method to be utilized for said method of making, providing a tooling means which allow the injection molding of said reflective pavement marker or delineator, integrally including the cube corner reflective elements in one step, said tooling can be made to mold said marker in one stage or two stage injection molding process either in one or two colors or material zones, integrally providing load carrying partition wall means which allow forming multiple cube corner reflective elements within inside of each reflective cell of said pavement marker during said injection molding process, providing the inclined angular position of said load carrying partition wall means with respect to the planar base surface of said pavement marker to allow uninterrupted ejection cycle during said injection molding of said reflective pavement marker or delineator, provide a mean to apply hard abrasion resistant film utilizing one of various suitable processes such as plasma enhanced chemical vapor deposition, reactive sputtering methods or ion beam sputtering to coat the outside surface of said pavement marker or delineator with abrasion resistant hard film of either carbon, silicon dioxide or aluminum oxides film, provide means for in-place marker dispensing and material injection system that can have the means for multiple marker stacking and guiding, dispensing and holding a marker in-place on the roadway during filling agglutination process, one or two components polymer injection system with heating elements and control means to synchronize the above in-place dispensing, filling and agglutination process.

It is understood that various changes or modifications can be made within the scope of the appended claims to the above-preferred method of forming one-piece reflective marker without departing from the scope and the spirit of the invention. The principle processes of this invention are not limited to the particular embodiments described herein. Various embodiments can employ the processes of this invention. This invention is not limited to the exact method illustrated and described; alternative methods can be used to form the intended monolithically formed reflective pavement marker of this invention.

Therefore, the invention can be practiced otherwise than as specifically described herein.

What is claimed is:

1. A method of in-place filling and agglutination of a hollowed one-piece reflective pavement marker, said pavement marker having a substantially hollowed structural body, a sagged, arcuate top surface that includes a hole for in-place injection of resinous structural material, said top surface also includes at least two bleeding holes, said pavement marker integrally includes two inclined planar faces with multiple reflective cells, said reflective cells each having an inside cell like area with multiple cube corner reflective elements, each reflective cell is supported by thin partition posts with upper periphery regions, said reflective cells are sealed with a thin plastic sheet, said pavement marker integrally having two arcuate sides each having a recessed grip region and a slightly recessed planar base surface defined by a periphery region, said base surface includes the open ends of said hollowed pavement marker, said method of in-place filling and agglutinating comprising:

a) providing tooling means which allow injection molding of said hollowed reflective pavement marker integrally including the cube corner reflective elements, said tooling means molds said pavement marker in one or two stage color or material injection molding cycle;

b) providing the thin interior posts with angular means defining multiple hollow cavity air gaps and providing periphery regions within the upper portions of said interior posts which allow sealing of said integrally formed cube corner reflective elements within a correspondingly shaped thin plastic sheet, whereby retaining the apexes of said cube corner reflective elements freely inside said hollow cavity air gaps;

c) providing a hard film coating means utilizing either reactive sputtering, plasma enhanced chemical vapor deposition means or ion beam sputtering to coat the exterior surface of said pavement marker with an abrasion resistance film, said film preferably selected from any of carbon, silicon dioxide, aluminum oxide or aluminum trioxides film, said coating means utilize any process that uses chemical film deposition chamber such as using radio frequency plasma decomposition from a gas, said plasma is excited using an electromagnetic alternating fields, said coating means also use reactive sputtering with pressure controller or ion beam sputtering process which can provide one or two stage gradual coating, said coating means use an adhesive enhancing first layer on said substrate surface and simultaneously followed by a hard coat thereafter; and d) providing means for in-place marker dispensing and polymeric material injection system to simultaneously fill and agglutinate said one-piece reflective pavement marker on designated roadway lanes, said injection means use means for multiple marker stacking, guiding and dispensing, said injection system uses an apparatus to hold a marker in-place on a roadway surface during said filling process, said one or two components polymer injection system uses heating elements and control means to simultaneously synchronize the above in-place dispensing, filling and agglutination process;

whereby said reflective pavement marker will be monolithically formed including said cube corner reflective elements with abrasion resistant carbon coated exterior surface and provided an in-place filling and agglutination means.

* * * * *